United States Patent [19]

Aysta et al.

[11] 4,444,449

[45] Apr. 24, 1984

[54] ELECTRICAL CONNECTOR

[75] Inventors: James E. Aysta, Stillwater, Minn.; Geoffrey Gibson; Rainer A. Tuukkanen, both of Hamburg, Fed. Rep. of Germany

[73] Assignee: Minnesota Mining and Manufacturing Company, St. Paul, Minn.

[21] Appl. No.: 346,486

[22] Filed: Feb. 8, 1982

[30] Foreign Application Priority Data

Mar. 16, 1981 [DE] Fed. Rep. of Germany ..... 3110144

[51] Int. Cl.[3] ..... H01R 13/38

[52] U.S. Cl. ..... 339/99 R; 339/103 M; 339/105

[58] Field of Search ..... 339/103 R, 103 M, 99 R, 339/97 P, 97 R, 107, 105, 106, 104, 103 C

[56] References Cited

U.S. PATENT DOCUMENTS

| | | | |
|---|---|---|---|
| 3,835,445 | 9/1974 | Hardesty | 339/105 X |
| 4,002,792 | 1/1977 | Hardesty | 339/99 R |
| 4,163,598 | 8/1979 | Biandi et al. | 339/107 |
| 4,195,898 | 4/1980 | Chow et al. | 339/103 R X |
| 4,270,832 | 6/1981 | Tanabe | 339/105 |

FOREIGN PATENT DOCUMENTS

| | | | |
|---|---|---|---|
| 2515688 | 4/1976 | Fed. Rep. of Germany | 339/103 M |
| 7409034 | 1/1976 | Netherlands | 339/107 |

*Primary Examiner*—William R. Briggs

*Attorney, Agent, or Firm*—Donald M. Sell; James A. Smith; Terryl K. Qualey

[57] ABSTRACT

An electrical connector for non-prestripped wires has a lower housing part (1) with wire guides, each comprising a double channel consisting of an upper introduction channel (47) having a cross-section suited for the introduction of a wire (7) and therebelow a parallel clamping channel (49) connected to the introduction channel by a constricted transition slit (51). A projection provided at an upper housing forces the wire at least partly into and through the transition slit (51) and into a recess (37) in the lower housing part (1) upon telescoping of the upper housing part into the lower housing part, thereby clamping the wire to strain relieve it.

6 Claims, 4 Drawing Figures

ELECTRICAL CONNECTOR

FIELD OF THE INVENTION

The present invention relates to a solderless electrical connector having strain relief for the individual wires.

BACKGROUND OF THE INVENTION

Solderless electrical connectors in which the conductor contact is reliably established by a simple assembling movement, have found widespread use because with such connectors, the particularly time consuming processes of stripping the insulation and soldering are eliminated. Such connectors are disclosed in U.S. Pat. Nos. 3,012,219; 3,573,713; and 3,656,088. In many cases, particularly where aluminum conductors are used, it has been found desirable to include a strain relief for the wires in the connector to prevent mechanical stresses on the wires from degrading the contact connection. To take full advantage of the increased assembly rates obtainable with such connectors the strain relief should be made effective by the same assembling movement which also establishes the electrical contact. Most of the known solderless connectors in which by a single assembling movement, the contact is established, as well as the conductor strain-relieved, employ two housing parts between which, upon assembling, the conductors are mechanically clamped, and contacted electrically. For example, in U.S. Pat. No. 3,576,518 a barb-like projection provided on one of the housing parts engages the insulation on the conductor. However, such projections may themselves cause conductor breakage, particularly with the use of fragile conductor materials like aluminum. Alternatively, the conductor has been clamped in a bend as in U.S. Pat. No. 3,936,128. With such clamping in a bend or loop of the conductor the contacting area can be strain relieved more effectively. However, as in the connector of U.S. Pat. No. 3,936,128, the deforming and clamping area of the strain relief has been provided at the wire entrance area spaced as far as possible from the contacting area, in order to be able to make the bend as large as possible and thus the strain relief as effective as possible. This, however, produces other disadvantages. Particularly with connectors in which the contacting area is protected against the influence of air by a filling material, movements of the conductors in the entrance area may loosen and work the filling material out of the housing. Furthermore, the electrical strength of the connector as a whole can be impaired if in the strain relief the insulation on the conductors is damaged or compressed upon clamping the conductors fast. Furthermore, it has been found that when connecting wires having fragile conductors, particularly aluminum, wire breaks may occur in the entrance area of the connector.

SUMMARY OF THE INVENTION

The connector of the present invention has a lower housing portion in which wire guide channels are provided for the introduction, to preassembled positions, of wires to be connected and an upper housing part which is adapted to be assembled, with the lower housing part by pressing them together. A slotted contact element is positioned in the housing to cut through the insulation and electrically connect the conductors of the wires upon pressing together the housing parts. A strain relief is provided for each of the wires and comprises a recess in the lower housing part, a projection in the upper housing part and a clamping channel in the lower housing part parallel to each wire guide channel and joined thereto by a constricted transition slit. Upon pressing together the housing parts the projection deforms the wire into the recess and clamps it there and a portion of the wire is forced into a constricted transition slit.

The connector of the present invention provides very high resistance to tensile and torsional stresses in the wires. This is due to the fact that in the clamping area the conductor extends through the constraining transition slit of the double channel at an acute angle to the direction of the double channel. Upon the occurrence of a tensile force on the conductor the conductor is forced along a greater length into the constricting transition slit thereby reducing the acute angle and forcing the wire more tightly into the slit. The tensile stresses are then distributed over a greater length of the wire insulation and there is less, not more, binding of the wire. Wire conductor breaks are thereby prevented even with soft conductor materials such as aluminum.

THE DRAWING

DESCRIPTION OF THE PREFERRED EMBODIMENT

Figure 1:
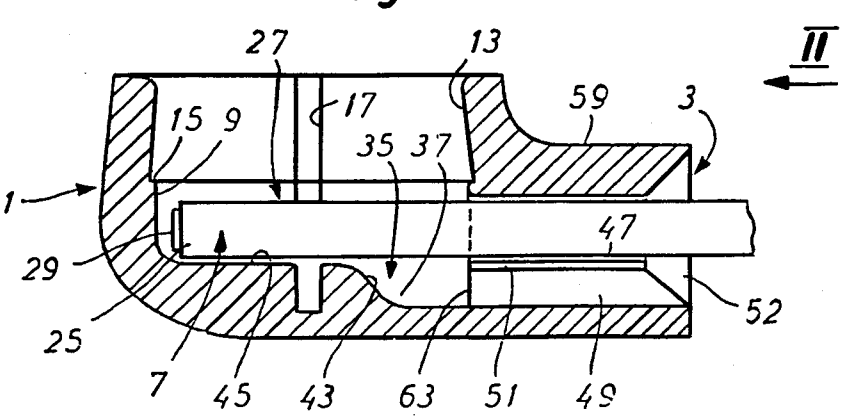
FIG. 1 is a longitudinal cross-sectional view of the lower housing part of a connector constructed in accordance with the present invention (the section being taken along line I—I of FIG. 2) with a wire inserted therein.

The electrical connector of the invention has a lower housing part 1 molded of an electrically insulating material in which wire guides are provided for the insertion of non-prestripped wires to be connected, to preassembled positions. The illustrated connector is constructed for connection of two wires and thus has two side-by-side wire guides 3 and 5. FIG. 1 illustrates a wire 7 inserted into the wire guide 3 to the preassembled position where the end of the wire 7 abuts the interior side wall 9 of the lower housing part 1.

An upper housing part 11 (FIG. 3) is formed to be telescopically inserted, up to an abutment 15, into a slightly tapered circular opening 13 in the top of the lower housing part 1. Proper orientation of the housing parts is insured by interengaging aligning means consisting of grooves 17 in the side walls of the lower housing part 1 and complementary protrusions 19 on the upper housing part 11. The upper housing part 11 includes a metal contact element 23 formed with connecting slots 31 and 33 which, upon pressing together the housing parts 1 and 11, cut through the insulation 25 of the inserted wires 7 and electrically contact and connect the conductors 29. The major part of the upper housing part is molded of an electrically insulating material in which the metal contact element 23 is retained by force fit.

Figure 3:
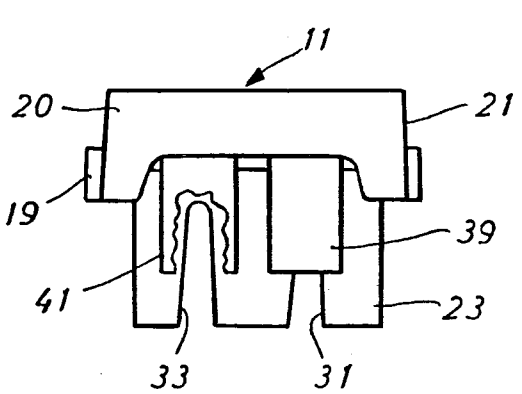
FIG. 3 is an end elevation view of an upper housing part constructed to fit within the lower housing part in the orientation thereof illustrated in FIG. 2.

The connector has a strain relief for each of the wires including a wire deforming area 35 provided in the lower housing part 1, a recess 37 provided in the deforming area and a wire deforming projection 39 provided on the upper housing part 11. Upon assembling the housing parts 1 and 11 the projection 39 deforms the wire 7 into the recess 37 and clamps it therein. In FIG. 3, a second projection 41 which cooperates with the other insertion path 5, is illustrated partly broken away to completely indicate the shape of the conductor connection slot 33.

Figure 4:
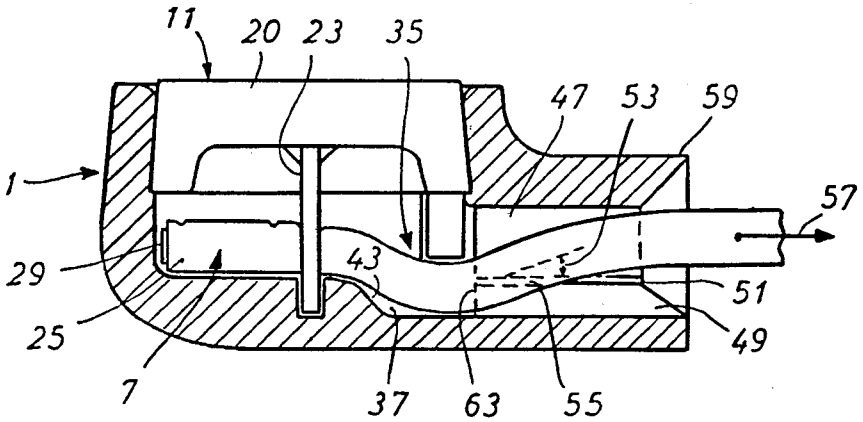
FIG. 4 is a side elevation view of the assembled connector with the wire being connected and strain relieved therein, the lower housing part being sectioned as in FIG. 1.

The recess 37 in the deforming area 35 merges along a radiused ramp 43 with a wire supporting surface 45 provided in the conductor connecting area 27. This supporting surface 45 is aligned with a wire introduction channel 47 which forms a part of the wire guide 3 and has a cross-section suited for the introduction of the wire 7. A clamping channel 49 extends below and parallel to each wire introduction channel 47 and connected to the introduction channel by a constricted transition slit 51. Thus, the introduction channel 47, the clamping channel 49 and the transition slit 51 interconnecting the same, form together a double channel 47, 49 which is outwardly closed around its periphery and forms the wire guide 3. The transition slit 51, and the cross-section of the clamping channel 49 are dimensioned so that upon assembling the housing parts 1, 11, the inserted wire 7 will be forced by the associated projection 39 of the upper housing part 11 at least partly into and through the transition slit 51, and will be clamped therein. This condition is illustrated in FIG. 4. As can be seen, the deforming and clamping area 35 is disposed in the interior opening area of the double channel 47, 49, whereby the portion of the double channel up to its outer opening area 52 forms a relatively long zone of protection which prevents excessive movements of the wire in the clamping area 35. Since the recess 37 into which the wire 7 is deformed is internal of the connector, a complete mechanical covering and electrical insulation will exist there even if the wire insulation 25 is damaged in the clamping area 35. Moreover, vibration or movement of the wire 7 outside of the connector will not produce movements in the interior of the connector which might work loose a filler protecting the wire connection.

As can be seen from FIG. 4, the wire 7 extends from the deforming and clamping area 35 through the transition slit 51 at an acute angle 53 to the direction 55 of the double channel. If a tensile force is applied to the wire 7 (in the direction of arrow 57 in FIG. 4) in the first instance the angle 53 will be decreased and the wire 7 will be forced over a greater length into the clamping transition slit 51. Concurrently, the wire insulation will be partly deformed resiliently, and the tensile force applied is distributed along the insulation without producing damaging bends in the conductor 29.

Figure 2:
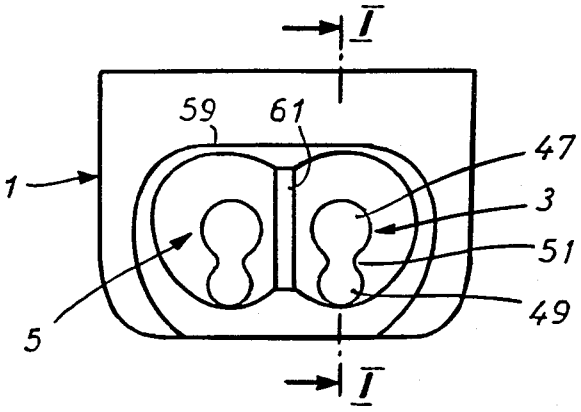
FIG. 2 is an end elevation view in the direction of the arrow II in FIG. 1.

In the illustrated embodiment the double channel 47, 49 extends outward within a lower housing projection 59. The wire guides 3 and 5 are side-by-side within the housing projection 59 and are separated from each other by a separation wall 61 (see FIG. 2). The double channel 47, 49 opens inwardly into the interior housing surface 63 (see FIGS. 1 and 4). Thereby, the whole interior of the lower housing part 1 can be utilized for the contacting area 27 and the deforming and clamping area 35.

Generally, it is desirable that the diameter of the clamping channel 49 be about 0.4 to 0.7, preferably about 0.5 to 0.6 times the diameter of the introduction channel 47. With wires that nearly fill the cross-section of the introduction channel 47, this will provide a margin of safety against complete snapping-over of the wire into the clamping channel 49 when a tensile stress is applied to it. On the other hand, however, a soft, complete snapping-over will not necessarily be disadvantageous as long as the wire will still remain reliably clamped in the transition slit 51. The width of the transition cross-slit 51 shall be about 0.2 to 0.4, preferably 0.25 to 0.35 times the diameter of the introduction channel 47. These values are useful in practice for wires that nearly fill the cross-section of the introduction channel 47 and have usual thickness ratios between conductor and insulation. Generally, a good combination of clamping action and small dimensional size of the connector will be obtained if the width of the clamping slit is selected to be approximately equal to the diameter of the conductor of the wires to be connected.

The length of the double channel 47, 49 is preferably at least twice the diameter of the introduction channel 47. Thereby, it is insured that from the deforming and clamping area 35, a sufficiently long portion of the wire 7 will extend in the wire guide 3 and thus will not be bent through such a sharp angle that the conductor might be damaged.

The housing is preferably molded of polycarbonate because this material has, in combination, high mechanical and electrical strength, high tenacity, and sufficient resilience. The contact element may be made of berylium copper as is common.

We claim:

1. An electrical connector for non-prestripped wires, comprising:

a lower housing portion having wire guides for insertion to preassembled positions of wires to be connected, each guide comprising a double channel with a wire introduction channel aligned with a wire connecting area within the lower housing and a parallel clamping channel of smaller cross-section connected to the introduction channel by a constricted transition slit, and a strain relief recess between said double channel and said wire connecting area, an upper housing portion adapted to be pressed into the lower housing portion, said upper housing portion having a slotted contact element which cuts through the wire insulation and electrically connects the wires upon pressing the housing parts together, and a projection for deforming the wire and clamping it in said lower housing recess while forcing a portion of the wire into and through said transition slit upon pressing the housing parts together.

2. A connector in accordance with claim 1, wherein the diameter of the clamping channel is about 0.4 to 0.7 times the diameter of the introduction channel.

3. A connector in accordance with claim 1, wherein the cross-section of the clamping channel is approximately equal to the cross-section of the conductor core.

4. A connector in accordance with claim 1, 2 or 3, wherein the width of the transition slit is about 0.2 to 0.4 times the diameter of the introduction channel.

5. A connector in accordance with claim 4, wherein the length of the double channel is at least about twice the diameter of the introduction channel.

6. A connector in accordance with claim 4, wherein the clamping channel opens into the deepest area of the strain relief recess.

* * * * *